US011375756B1

(12) United States Patent
White et al.

(10) Patent No.: US 11,375,756 B1
(45) Date of Patent: Jul. 5, 2022

(54) FILTER UNDERWEAR

(71) Applicants: Collin White, Saint Helena, CA (US); Robert White, Scottsdale, CA (US)

(72) Inventors: Collin White, Saint Helena, CA (US); Robert White, Scottsdale, CA (US)

(73) Assignee: Stitches Medical, Inc., Napa, CA (US)

( * ) Notice: Subject to any disclaimer, the term of this patent is extended or adjusted under 35 U.S.C. 154(b) by 0 days.

(21) Appl. No.: 17/675,684

(22) Filed: Feb. 18, 2022

(51) Int. Cl.
*A41B 9/02* (2006.01)
*A41B 9/00* (2006.01)
*A41B 9/14* (2006.01)

(52) U.S. Cl.
CPC ..... *A41B 9/02* (2013.01); *A41B 9/001* (2013.01); *A41B 9/004* (2013.01); *A41B 9/14* (2013.01); *A41B 2400/36* (2013.01)

(58) Field of Classification Search
CPC ..... A41B 9/02; A41B 9/001; A41B 9/004; A41B 9/14; A41B 2400/36
See application file for complete search history.

(56) References Cited

U.S. PATENT DOCUMENTS 1,784,744 A 12/1930 Negley
2,116,822 A * 5/1938 Samuell ..... A41B 9/02 2/404
2,384,165 A 5/1945 Goldfarb et al.
2,435,945 A 2/1948 Redmond
3,246,341 A * 4/1966 Paolucci ..... A41B 9/02 2/404
3,706,103 A 12/1972 Senser
4,143,197 A 3/1979 Jasionowicz
5,546,607 A 8/1996 Roberts
5,593,398 A 1/1997 Weimer
5,665,081 A 9/1997 Grosse
7,745,684 B2 6/2010 Huza et al.
7,934,268 B2 5/2011 Newman
8,051,495 B2 11/2011 Lee
8,935,813 B2 1/2015 O'Leary
9,924,746 B1 * 3/2018 Davis ..... A41B 9/023
11,154,431 B1 10/2021 Yip et al.
2003/0187412 A1 10/2003 Martin
2004/0010841 A1 1/2004 Gilmartin
2005/0182372 A1 8/2005 Huza
2007/0032771 A1 * 2/2007 Abed ..... A61F 13/49006 604/385.22
2016/0286971 A1 10/2016 Pan
2019/0320726 A1 * 10/2019 Profeta ..... A41B 17/00
2020/0054495 A1 * 2/2020 Pelt ..... A61F 13/5616
(Continued)

*Primary Examiner* — Khaled Annis
(74) *Attorney, Agent, or Firm* — Kenneth Altshuler

(57) ABSTRACT

The embarrassment of passing gas in public is ubiquitous. One solution is to wear a filter underwear that is generally constructed with a single ply of underwear side panels that are separated by an activated carbon center panel. The activated carbon center panel is attached to an elastic waistband at the underwear back and where the activated carbon center panel traverses between two leg openings to the waistband at the underwear front. The center panel is constructed with a five-ply activated carbon fabric that is sandwiched between cotton fabric, which is sandwiched between bamboo fabric. The five-ply center panel is greater than 1 mm thick to provide filtering capabilities to sufficiently reduce the odor of flatulence to an acceptable level that is not readily detected by a person close by.

20 Claims, 7 Drawing Sheets

(56) References Cited

U.S. PATENT DOCUMENTS

| | | | | |
|---|---|---|---|---|
| 2020/0079051 | A1 | 3/2020 | Nicholson | |
| 2020/0170309 | A1* | 6/2020 | Ewell | B32B 5/028 |
| 2021/0177068 | A1* | 6/2021 | Karabetyan | A41B 9/023 |
| 2021/0206144 | A1* | 7/2021 | Ewell | A61F 13/49 |
| 2021/0259326 | A1* | 8/2021 | Shaughnessy | A41B 9/001 |
| 2021/0298369 | A1* | 9/2021 | Polstein | A41D 31/305 |
| 2022/0079250 | A1* | 3/2022 | Calamia | A41B 9/001 |

* cited by examiner

FILTER UNDERWEAR

CROSS-REFERENCE TO RELATED APPLICATIONS

None

FIELD OF THE INVENTION

The present embodiments are directed to undergarments.

BACKGROUND OF THE INVENTION

The embarrassment of passing gas in public is typically offensive to those who are subject to its odor. Some have attempted to hide the offensive odor of flatulence with perfumes and filters. Attempts have been made to incorporate perfumes and filters in garments with varied levels of success. In certain instances, difficult to manufacture panel shapes have been incorporated in clothing, such as underwear described in U.S. Pat. No. 8,935,813 to O'Leary. O'Leary teaches a non-filter material bounded between a portion of filter material and edging at the underwear leg opening in bikini style briefs requiring complex seams that need to be sewn, which is undesirable in a manufacturing environment. Furthermore, O'Leary teaches a filter material that extends from a waist band on the rear side of his garment, down to the gusset region and through the gusset such that the filter material section terminates at a seam on the front panel. This design is poor because it does nothing to prevent passed gas from flowing through the non-filter material in the front between the front seam and the waist band. Others have attempted to make entire undergarments out of filter material, but this is cumbersome, uncomfortable to the wearer and simply an unsuccessful approach in controlling the escape of flatulence. Still others espouse the advantages of underwear that is under 1 mm thick, which is sorely deficient in properly reducing flatulence odor and therefore considered inferior for such purposes. It is to innovations related to this subject matter that the embodiments of the invention are generally directed.

SUMMARY OF THE INVENTION

The present embodiments are directed to odor controlling underwear.

With this in mind, certain embodiments of the present invention therefore contemplate an underpants embodiment that generally comprises an underpants body that extends between a waist aperture and two leg apertures. The underpants body is geometrically defined by two underpants sides, an underpants front and an underpants back. Each of the leg apertures extend from one of the underpants sides to a crotch region of the underpants body. An inseparable unitary elastic waistband defining the waist aperture. The underpants body comprises two side panels, a center panel as well as connective stitching that holds the side panels and the center panel together. The connective stitching also confines the center panel and all of its laminated plies irremovably to the underpants body. Each of the side panels extend from the waistband to a corresponding one of the leg apertures. Each of the side panels completely encompass a corresponding one of the underpants sides. The center panel extends from the waistband at the underpants back to the waistband at the underpants front. The center panel is interposed between the side panels. The center panel passes though the crotch region of the underpants contiguously. The side panels consist of fabric that is a single layer of bamboo fabric. The center panel consists of activated carbon fabric bonded, via a bonding agent, to and sandwiched between a first layer of cotton fabric and a second layer of cotton fabric, the cotton fabric is irremovably sandwiched between an inner layer of the bamboo fabric and an outer layer of the bamboo fabric. By irremovably sandwiched it is meant that the activated carbon fabric and cotton fabric (the laminate) cannot be removed from the underpants without destroying the underpants because the laminate is sewn into, or otherwise irremovably attached to, the laminate.

Yet another embodiment of the present invention further contemplates a filter undergarment comprising an undergarment body defined by two undergarment sides, an undergarment front and an undergarment back. The undergarment body extends between an inseparable unitary elastic waistband (waistband) and two leg apertures. The filter undergarment further has a waist aperture that is defined by a waistband edge of the waistband. A center panel extends from the waistband at the under garment back and traverses between the two leg apertures to the undergarment front. The center panel is a five-ply filter fabric essentially composed of an activated carbon fabric that is bonded between two cotton fabric panels that are sandwiched and attached between two bamboo fabric panels. By 'essentially composed' it is meant that there may be thread, glue or other minor elements that hold together the center panel or provide attachment to the side panels but the majority of the panels are the activated carbon fabric, cotton panels and the bamboo panels. One-ply bamboo fabric encompasses the two undergarment sides. There are two leg cuffs each of which define one of the two leg apertures, the leg cuffs comprising a one-ply bamboo fabric folded over itself. A center panel-to-cuff interface defines where the center panel interfaces each of the leg cuffs. The center panel extends between 35%-75% of the leg cuffs along and adjacent to the center panel-to-cuff interface and towards the two underpants sides in the undergarment front and the undergarment back.

Still another embodiment of the present invention contemplates a filter underwear generally comprising an undergarment body defined by two undergarment sides, an undergarment front and an undergarment back, wherein the undergarment body extending between an inseparable unitary elastic waistband (waistband) and two leg apertures. A waist aperture is defined by a waistband edge of the waistband. The filter underwear further includes a center panel attached to and extends from the waistband at the under garment back and traversing between the two leg apertures to the waistband at the undergarment front. The center panel is configured to only extend over part of a wearer's buttocks when worn by a wearer. The center panel is a filter fabric comprising five plies, wherein each ply is from a set consisting of an activated carbon fabric, a cotton fabric, a bamboo fabric. The activated carbon fabric is bonded between two sheets of cotton fabric that are sandwiched between and irremovably attached to bamboo fabric. The center panel is greater than 1 mm thick. The filter underwear has one-ply bamboo fabric side panels that each comprise one of the undergarment sides. The undergarment body is permeable to gas and vapor. The waistband can further comprise the activated carbon fabric in yet another embodiment.

DETAILED DESCRIPTION

Figure 1A:
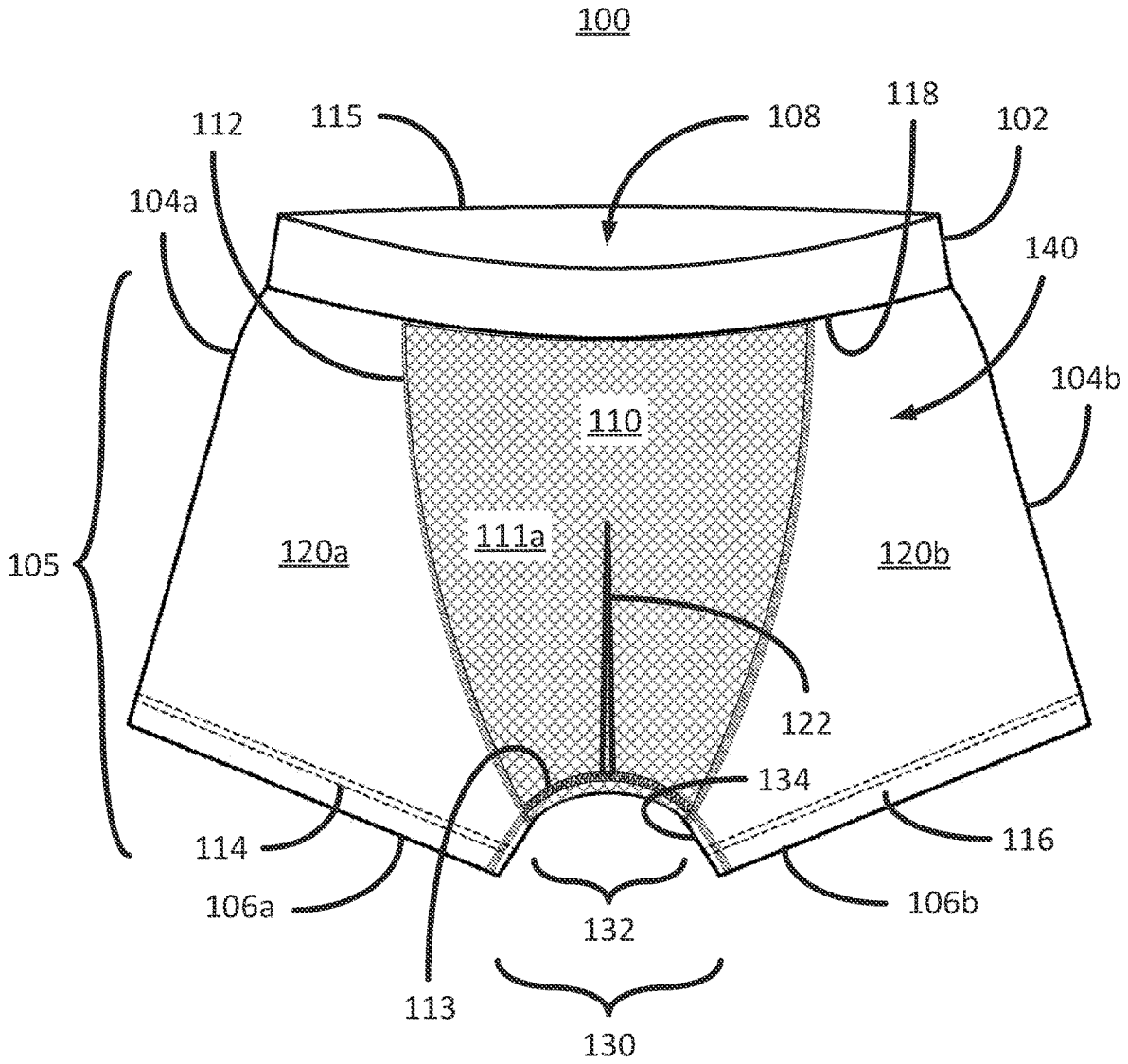
FIGS. 1A and 1B are line drawings of front and back views of underpants embodiments consistent with embodiments of the present invention.

Initially, this disclosure is by way of example only, not by limitation. Thus, although the instrumentalities described herein are for the convenience of explanation, shown and described with respect to exemplary embodiments, it will be appreciated that the principles herein may be applied equally in other similar configurations involving similar uses of filter material with undergarments. The phrases "in one embodiment", "according to one embodiment", and the like, generally mean the particular feature, structure, or characteristic following the phrase, is included in at least one embodiment of the present invention and may be included in more than one embodiment of the present invention. Importantly, such phases do not necessarily refer to the same embodiment. If the specification states a component or feature "may", "can", "could", or "might" be included or have a characteristic, that particular component or feature is not required to be included or have the characteristic. As used herein, the terms "having", "have", "including" and "include" are considered open language and are synonymous with the term "comprising". Furthermore, as used herein, the term "essentially" is meant to stress that a characteristic of something is to be interpreted within acceptable tolerance margins known to those skilled in the art in keeping with typical normal world tolerance, which is analogous with "more or less." For example, essentially flat, essentially straight, essentially on time, etc. all indicate that these characteristics are not capable of being perfect within the sense of their limits. Accordingly, if there is no specific +/− value assigned to "essentially", then assume essentially means to be within +/−2.5% of exact. In what follows, similar or identical structures may be identified using identical callouts.

The embarrassment of passing gas in public is ubiquitous. Accordingly, certain aspects of the present invention are directed to providing filter underwear that is generally constructed with a single ply of underwear side panels that are separated by an activated carbon center panel. The activated carbon center panel is attached to an elastic waistband at the underwear back and where the activated carbon center panel traverses between two leg openings to the waistband at the underwear front. The center panel is configured to only extend over part of a wearer's buttocks when worn by a wearer. The center panel is constructed with a five-ply activated carbon fabric that is sandwiched between cotton fabric, which is sandwiched between bamboo fabric. The five-ply center panel is greater than 1 mm thick to provide filtering capabilities to sufficiently reduce the odor of flatulence to an acceptable level that is not readily detected by a person close by to the wearer of the activated carbon underwear. The embodiments described below in view of the figures illustrate examples of filter underwear to assist in understanding aspects of the present invention.

Figure 1B:
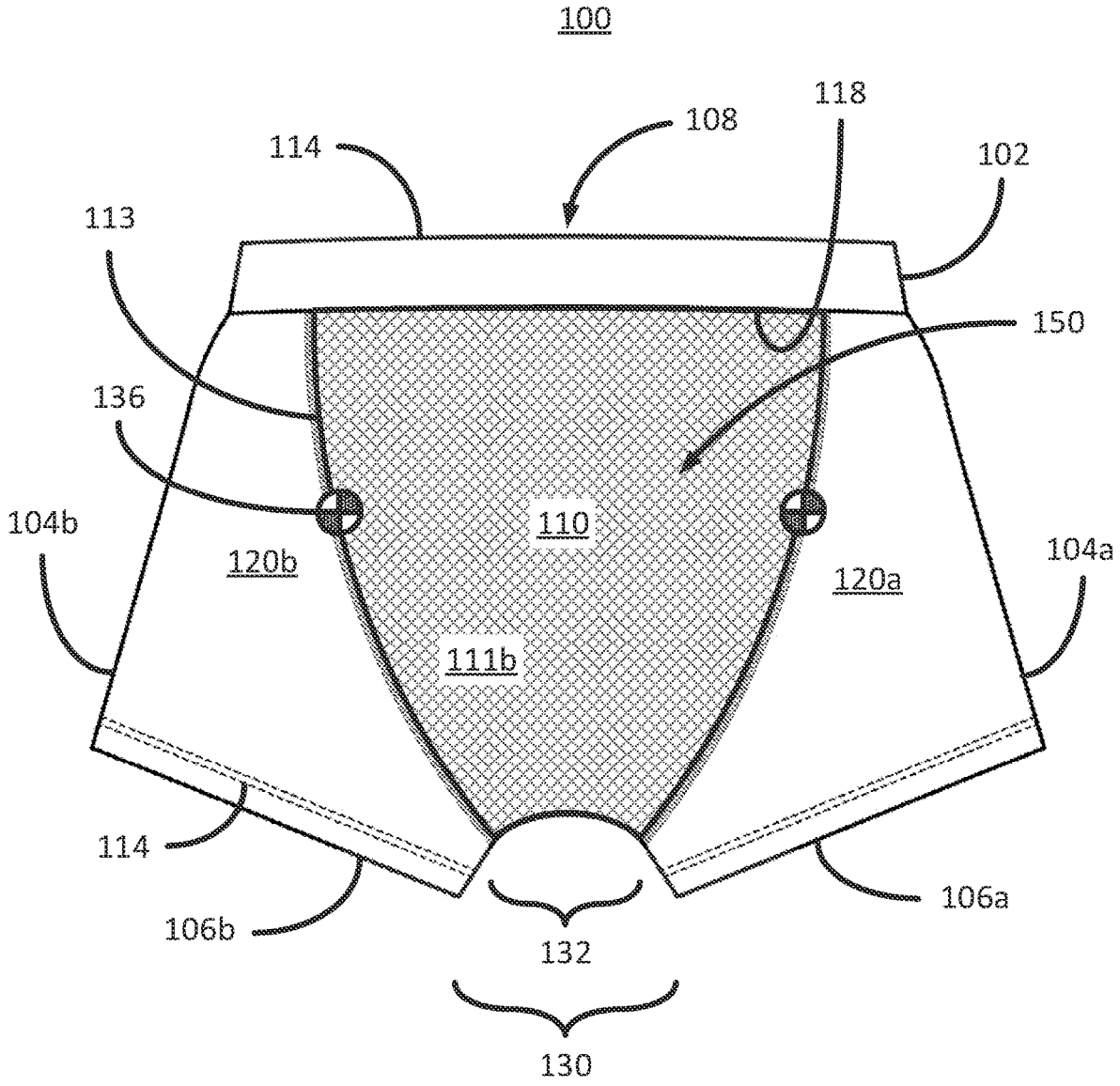

FIGS. 1A and 1B are line drawings of front and back views of underpants embodiments consistent with embodiments of the present invention. As shown in FIG. 1A, the underpants embodiment 100 generally comprises an underpants body 105 that extends between a waist opening 108 and two leg openings 106*a* and 106*b*. The terminology "opening/s" as used herein is synonymous with "apertures" and can be positively recited as "apertures". Also, the leg openings 106*a* and 106*b* can be generically called-out as element 106, meaning a leg opening 106 could be either leg opening 106*a* or 106*b* and leg openings 106 can refer to both leg openings 106*a* and 106*b*. In this embodiment, the underpants body 105 includes the side panels 120*a* and 120*b*, the center panel 110 and all connective stitching, such as the front side panel interface 112 (i.e., seams) that fixedly connect the panels 120 and 110 together. The side panels 120*a* and 120*b* can be generically called-out as element 120, meaning a side panel 120 could be either side panel 120*a* or 120*b* and side panels 120 can refer to both side panels 120*a* and 120*b*. At its open edge 115, an inseparable unitary elastic waistband 102 defines the waist opening 108. The inseparable unitary elastic waistband 102 is sewn to the side panels 120 and the center panel 110 at waistband seam 118. The elastic waistband 102 is inseparable and unitary in that it is a single band that is sewn together. As such, one part of the elastic waistband 102 cannot be separated from another part of the elastic waistband 102 without destroying the elastic waistband 102, hence inseparable and unitary. A separable waistband is considered a waistband that creates a waistband hoop by closing at least two ends with a nonpermanent closing connector, such as Velcro, latches, snaps, tape, etc. These nonpermanent closing connectors permit separating a separable waistband as well.

The underpants garment 100 is geometrically defined by two underpants sides 104*a* and 104*b*, an underpants front 140 (FIG. 1A), an underpants back 150 (FIG. 1B), the underpants waist opening 108, and a crotch region 130 that separates the leg openings 106. The two underpants sides 104*a* and 104*b* can be generically called-out as element 104, meaning an underpants side 104 could either be underpants side 104*a* or 104*b* and underpants sides 104 can refer to both underpants sides 104*a* and 104*b*. As shown, the underpants' crotch region 130 (or simply crotch region) is defined as the material between each of the leg openings 106, wherein each leg opening 106 extends from a corresponding underpants side 104 to the crotch region 130. In the present embodiment, there is no gusset in the crotch region 130 thereby reducing the number of manufacturing steps. The elimination of a gusset is believed far superior in the overall construction, with minimal to no sacrifice in comfort. Nonetheless, certain embodiments could utilize a gusset in the crotch region without departing from core aspects of the present invention. In the present embodiment, a center panel crotch portion 132 is smaller than, but incorporated in, the 'overall' crotch region 130 that separates the leg openings 106. The leg openings 106 include a leg cuff 116 of folded over material from the corresponding side panel 120 that is sewn in place by leg seam 114. Some embodiments envision the leg cuff 116 incorporating an elastic band.

Figure 3:
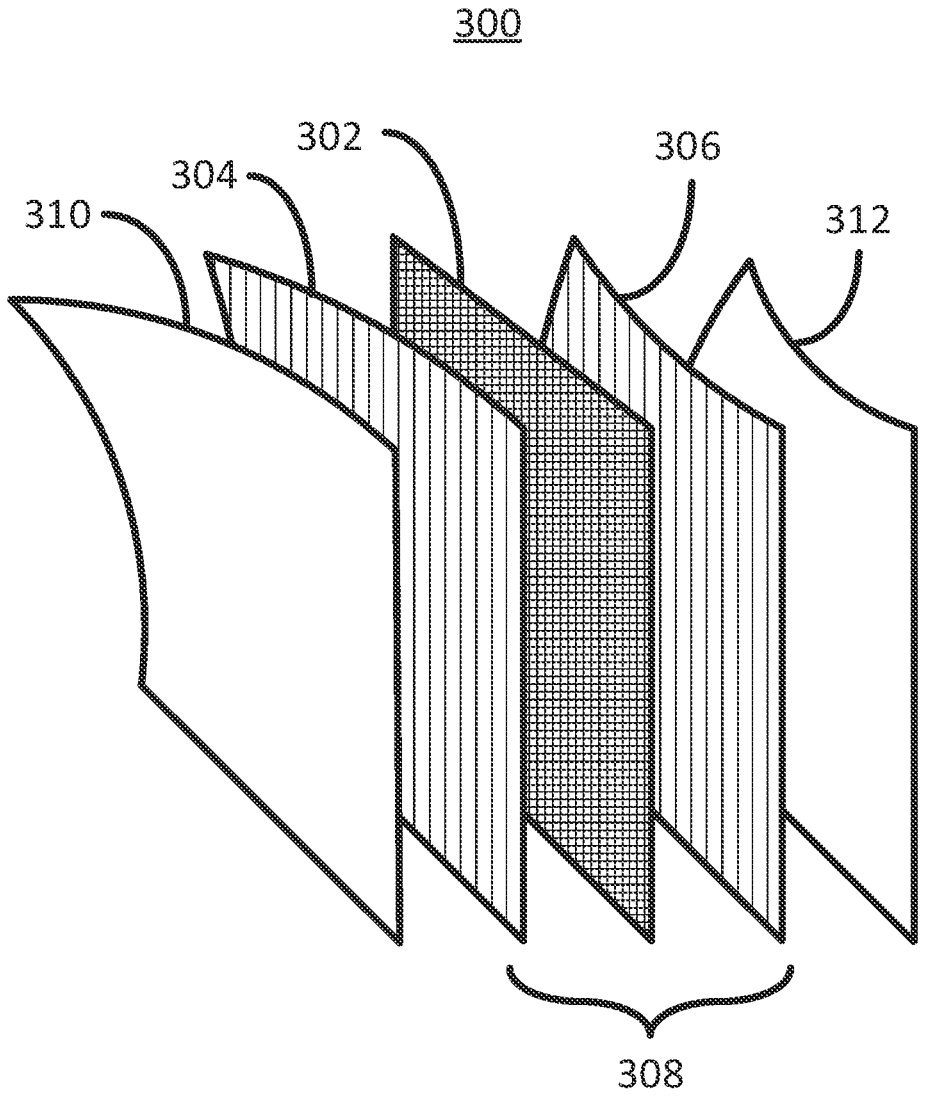
FIG. 3 is a line drawing of a five-ply filter panel consistent with the embodiments of the present invention.

The center panel 110 extends from the elastic waistband 102 at the underpants back/posterior side 150 (FIG. 1B), through the crotch region 130 and to the elastic waistband 102 at the underpants front side 140 (FIG. 1A). As shown in FIG. 3 in certain embodiments, the center panel 110 is a single layer of five-ply filter material 300 with an activated carbon fiber filter material 302 sandwiched between and bonded to both an inner layer of cotton fabric 304 and an outer layer of cotton fabric 306 that are all sandwiched between an inner layer of bamboo fabric 310 and an outer layer of bamboo fabric 312. In some embodiments, the bamboo fabric 310/312 is a bamboo rayon fiber textile, which when attached to the cotton and activated carbon fiber filter material 302, provides odor filtering and wicking superior to that of other filtration laminated textile arrangements. In the present embodiment, the center panel 110 comprises a single sheet of five-ply filter material 300, meaning that the center panel 110 is not formed from multiple sheets of five-ply filter material 300 sewn together. Other embodiments contemplate the center panel 110 having only a front panel 111*a* and a rear panel 111*b* that are sewn together at a rear transfer seam 113 at the crotch region 130. When sewn together, the front panel 111*a* and the rear panel 111*b* create a contiguous (single) center panel 110, wherein the center panel 110 passes through the crotch region 130. One embodiment of the five-ply filter material 300 contemplates the inner layer of cotton fabric 304 and an outer layer of cotton fabric 306 bonded to the activated carbon fiber filter material 302 via a spray on glue, which is then heated to create the bond. The cotton-carbon laminate 308 (cotton and activated carbon fiber laminate) can be sewn between the bamboo fabric 310/312 to provide added comfort to the wearer. One reason for the five-ply filter material 300 is because the glue and heat process of bonding may cause the bonding fabric to "carbonize" and become less comfortable to the wearer. Some embodiments envision replacing the cotton fabric layers 304/306 with bamboo fabric layers to create a bamboo-carbon laminate (same structure as element 308). Here, there is an inner and outer bamboo layer bonded directly to the activated carbon fiber filter material 302 via a spray on glue. The bamboo-carbon laminate (308) is sewn between the bamboo fabric 310/312 to provide added comfort to the wearer because the glue that is heated and bonded may be stiff and therefore uncomfortable to the wearer. The cotton-carbon laminate 308, or the bamboo-carbon laminate (308), are irremovably integrated in the center panel 110, meaning that laminate 308 cannot be removed from the underpants 100 without tearing or otherwise destroying the underpants 100.

As shown in FIG. 1A, the center panel 110 further comprises a crotch dart 122 that is essentially an expansion joint that can expand outwardly to provide room for the male anatomy. The center panel 110 is interposed between the side panels 120 in a way that separates the side panels 120 from contacting one another. In other words, the center panel 110 separates the two side panels 120. In the present configuration, the underpants 100 is considered boxer briefs whereby the inner leg extension 134 is part of the side panel 120. The inner leg extensions 134 of both side panels 120 are not in contact because the center panel crotch portion 132, of the center panel 110, separates them (the inner leg extensions).

In the present underpants embodiment 100, the side panels 120 are envisioned as being a one-ply of bamboo fabric (meaning the side panels 120 consist of a one-ply bamboo fabric that include nothing other than a one-ply bamboo fabric other than stitching). The one-ply of bamboo fabric can be the same bamboo rayon fiber textile that is used in the outer layers 310/312 of the five-ply center panel 110, except without any other layers of fabric bonded thereto, hence, one-layer. Certain embodiments contemplate the bamboo fabric side panels 120 being the same type of bamboo material as the outer layers 310/312 of the five-ply center panel 110 but with a different thickness, such as a thicker bamboo fabric, for example. In certain embodiments, each side panel 120 can be constructed with a seam sewn along the underpants side 104 and at the inner leg portion 134. While other embodiments contemplate each side panel 120 being constructed from a single sheet of bamboo material with no seam sewn along the underpants side 104.

In the underpants embodiment 100, the center panel 110 flares outwardly from the center panel crotch region 132 (in the direction of) to the waistband 102 in the underwear front 140, as shown in FIG. 1A. More specifically, in the underwear front 140, the narrowest portion of the center panel 110 is in the center panel crotch region 132 and the widest point of the center panel 110 is where it meets the waistband 102 at the waistband seam 118. In the present embodiment, the center panel 110 is convex shaped at the front side panel interface 112 (front center-to-side panel seam). However, other embodiments envision the front side panel interface 112 being a straight line or optionally the center panel 110 being concave shaped at the front side panel interface 112.

As shown in FIG. 1B, the center panel 110 flares outwardly from the center panel crotch region 132 to the waistband seam 118 in the underwear back/posterior 150. In the present embodiment, the center panel 110 is convex shaped at the rear side panel interface 113 (rear center-to-side panel seam). In certain embodiments, the rear side panel interface 113 tracks over, or otherwise traverses, a person's buttocks apex, shown here as target 136. The buttocks apex is defined as to top or highest part of the buttocks as viewed when a person (owner of the buttocks) is lying on their stomach. In some other embodiments, the rear side panel interface 113 does not track over a person's buttocks apex 136, but rather closer to the underpants sides 104. In the present embodiment, the center panel 110 comprises a broader wedge shape in the rear side 150 than the front side 140. Accordingly, the length of the waistband seam 118 at the waistband 102 in the center panel 110 is larger in the rear side 150 than the front side 140 (FIG. 1A), as shown.

Figure 1C:
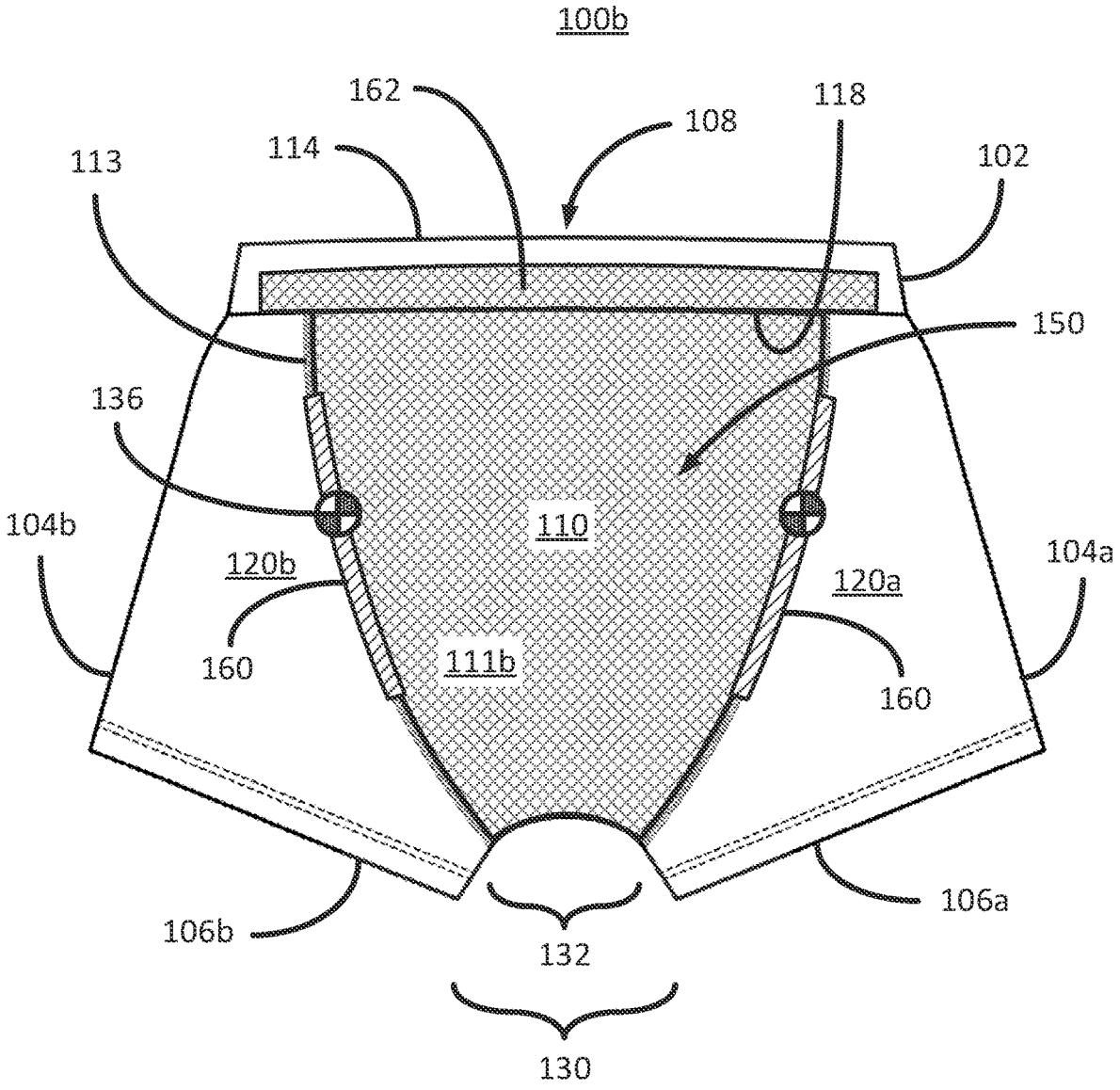
FIG. 1C is a line drawing of a back view of yet another underpants embodiment consistent with embodiments of the present invention.

FIG. 1C is a line drawing of a back view of yet another underpants embodiment consistent with embodiments of the present invention. FIG. 1C is a boxer brief embodiment 100*b*, which is similar to the underpants embodiment 100 of FIGS. 1A and 1B but with a couple of modifications. In this boxer brief embodiment 100*b*, an elastic seam band 160 is sewn into the seam of the rear side panel interface 113 (on both sides). In this embodiment, the elastic seam band 160 takes up a portion of the rear side panel interface 113, however other embodiments envision the elastic seam band 160 extending along the entirety of the rear side panel interface 113. Here, the elastic seam band 160 resides at (or in the vicinity of) the buttocks apex 136. Certain embodiments further envision the elastic seam band 160 residing at least along a portion of the front side panel interface 112 (not shown in FIG. 1C). Other embodiments envision a plurality of elastic seam bands 160 dispersed along the rear side panel interface 113, the front side panel interface 112 or both. The elastic seam band 160 can improve the contact of the underpants 100*a* on the wearer's body especially at the front side panel interface 113 and/or rear side panel interface 112, thereby improving carbon filtering of flatulence/gas through the center panel 110.

Another embodiment of the present invention as shown in FIG. 1C envisions waistband carbon filter material 162 integrated in the waistband 102. The waistband carbon filter material 162 is envisioned to improve additional filtering of flatulence at the baseband 102. Waistband carbon filter material 162 can be part of the center panel 110 extending into the waistband 102, or optionally, an independent piece of carbon filter material 162, shown here along the waistband seam 118. The carbon filter material 162 can be a five-ply filter material 300, a three-ply carbon filter material, simply carbon filter material or some other carbon filter material arrangement. The baseband carbon filter material 162 can be sandwiched in the waistband 102, or optionally can be attached to the inner or outer surface of the waistband 102.

Figure 2A:
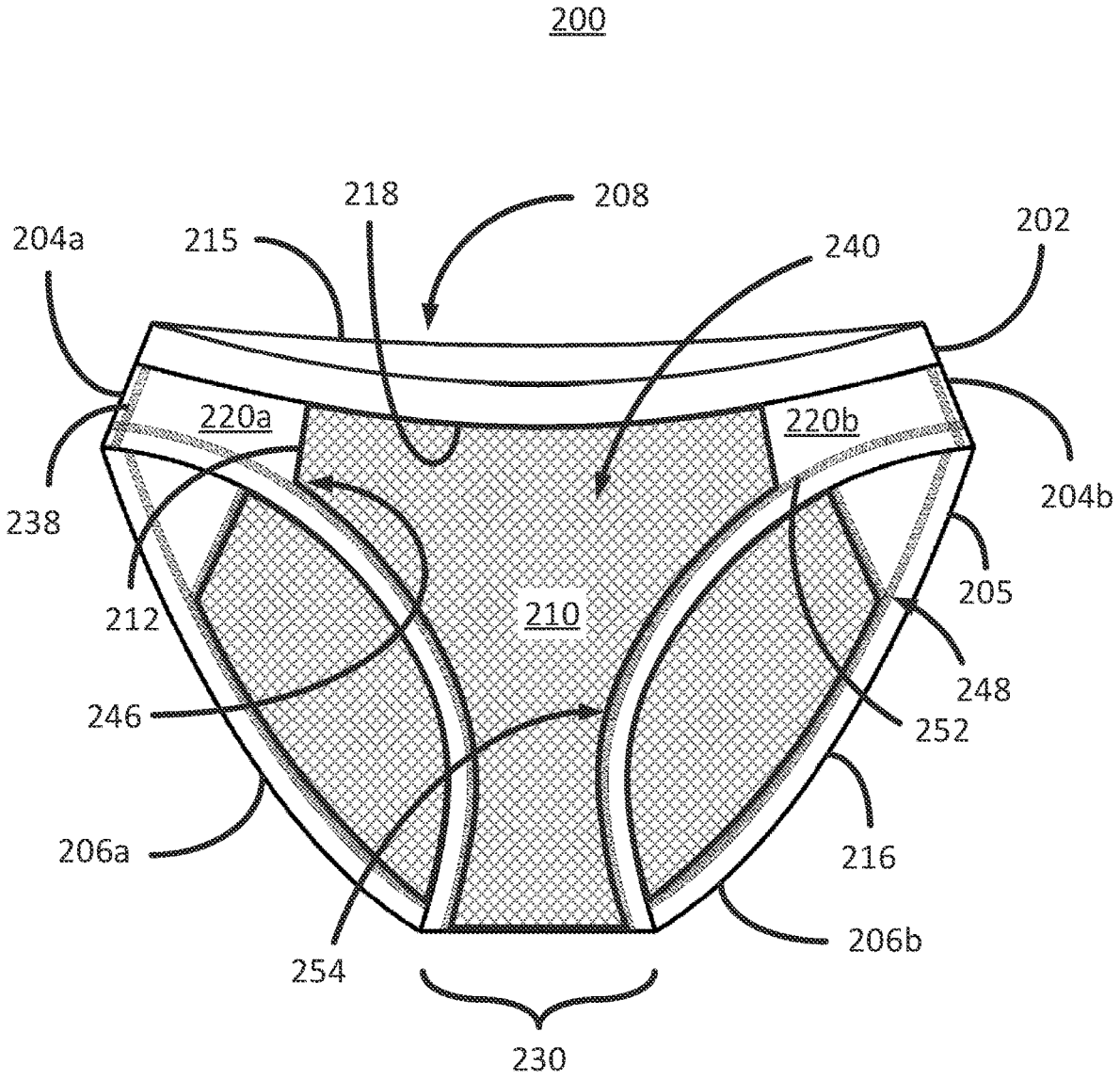
FIGS. 2A and 2B are line drawings of front and back views of a bikini style underpants embodiment consistent with embodiments of the present invention.
Figure 2B:
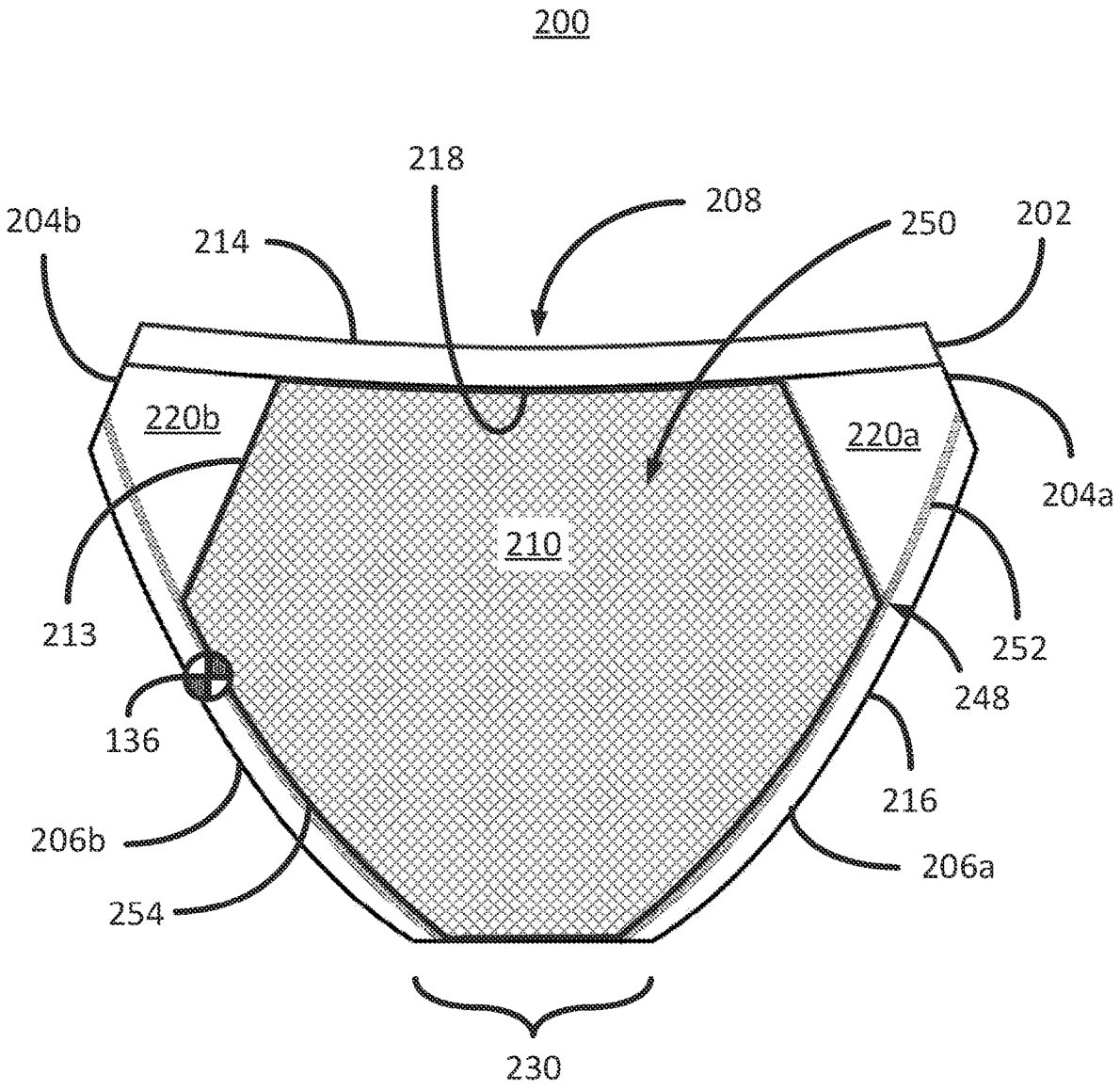

FIGS. 2A and 2B are line drawings of front and back views of a bikini style underpants embodiment (that is intended to be worn by females) consistent with embodiments of the present invention. As shown in FIG. 2A, the underpants embodiment 200 generally comprises a waistband 202 that is sewn to a bikini body 205. The biking body 205 generally comprises a center panel 210 and two side panels 220*a* and 220*b*, which generically are considered element 220. The bikini open edge 215 of the waistband 202 defines the bikini waist opening 208 of the bikini style underpants 200. The bikini body 205 extends between the bikini waist opening 208 and two leg openings 206*a* and 206*b*, generically considered element 206. The leg openings 206 are defined by corresponding leg cuffs 216, which in one embodiment is a folded over one-ply bamboo fabric. Other embodiments envision the leg cuffs 216 further comprising an elastic band (not shown) inside/between each folded over one-ply bamboo leg 216.

The bikini style underpants 200 are geometrically defined by two bikini sides 204*a* and 204*b*, a bikini front 240 (FIG. 2A) and a bikini back 250 (FIG. 2B), a bikini waist opening 208 and a bikini crotch region 230 that separates the leg openings 206. As shown in the present embodiment, there is no gusset in the bikini crotch region 230, which is defined by the center panel 210 (which is a five-ply filter material 300) and the leg cuffs 216. However, certain embodiments can include a gusset in the crotch region 230. The center panel 210 at the bikini front 240 extends along the center panel-to-cuff interface 254 at more than 50% of the leg cuffs 216 towards the bikini sides 204. In the present embodiment, the center panel 210 extends along the center panel-to-cuff interface 254 along and adjacent to the leg cuffs 216 at about 66%+/−5% of the leg openings 206 in the bikini front 240. By 'along and adjacent to' it is meant that the center panel 210 interfaces with, and is connected to, the leg cuffs 216 by way of a leg cuff seam 252. In the present embodiment, the center panel 210 extends from the leg cuff seam 252 towards the waistband 202 where the center panel 210 is sewn to the waistband 202 at the waistband interface 218 in the bikini front 240. The center panel 210 separates the one-ply side panels 220 so that they are not contiguous, immediately adjacent or next to one another. As shown, the center panel 210 transitions from the leg cuff seam 252 towards the waistband 202 at essentially a sharp angle 246, which in this embodiment is approximately 110°, but in certain embodiments is envisioned to be between 80° and 140°. A 'sharp angle' is defined as two sides (besides being straight lines, arched, or some combination) that form the angle where they meet at an apex (point) as opposed to meeting at a curve that transitions to the two sides. The side panel leg cuff seam 252 includes the center panel-to-cuff interface 254 where the center panel 210 meets the leg cuff 206.

In the present embodiment, the front panel 210 extends from the waistband interface 218 at the bikini front 240 (FIG. 2A) to the waistband interface 218 at the bikini back 250 (FIG. 2B). With regards to the bikini back 250 of FIG. 2B, the center panel 210 extends along more than 50% of the leg cuffs 216 towards the bikini sides 204. In the present embodiment, the center panel 210 extends along and adjacent to the leg cuffs 216 at about 66%+/−5% of the leg openings 206 in the bikini back 250. The center panel 210 extends from the leg cuff seam 252 from a center panel-to-cuff interface 254 towards the waistband 202 where the center panel 210 is sewn to the waistband 202 at the waistband interface 218 in the bikini back 250. As shown, the center panel 210 transitions from the center panel-to-cuff interface 254 of the leg cuff seam 252 to the side-to-center panel interface 213 towards the waistband 202 at essentially a sharp angle 248, which in this embodiment is approximately 125°. Some embodiments envision the center panel-to-cuff interface 254 to the side-to-center panel interface 213 to be between 100° and 170°. As shown in FIG. 2A, there is no non-filter material (i.e., there is no one-ply bamboo fabric) between the center panel 210 and the leg cuffs 216 at the center panel-to-cuff interface 254. In the present embodiment, the leg cuffs 216 traverse a person's buttocks apex 136 somewhere along the center panel-to-cuff interface 254. Other embodiments envision neither the leg cuff 216 nor the center panel-to-cuff interface 254 traversing a person's buttocks apex 136 (FIG. 2B). Still, other embodiments envision that no part of the center panel-to-cuff interface 254 or the center-to-side panel interface 213 traversing a person's buttocks apex 136. Here, the center-to-side panel interface 213, which is defined by the attachment seam of the bikini side panel 220 to the center panel 210, is essentially a straight line. In the present embodiment, the bikini side panels 220 are each formed of two pieces of one-ply bamboo fabric connected by a bikini side seam 238. However, other embodiments contemplate the bikini side panels 220 being a single panel/piece of one-ply bamboo fabric. In this embodiment, the bikini sides 204 are between 1 inch and 3 inches as defined from the bikini open edge 215 to each bikini leg opening 206 (which is the shortest distance between the bikini open edge 215 and the bikini leg opening 206).

Figure 2C:
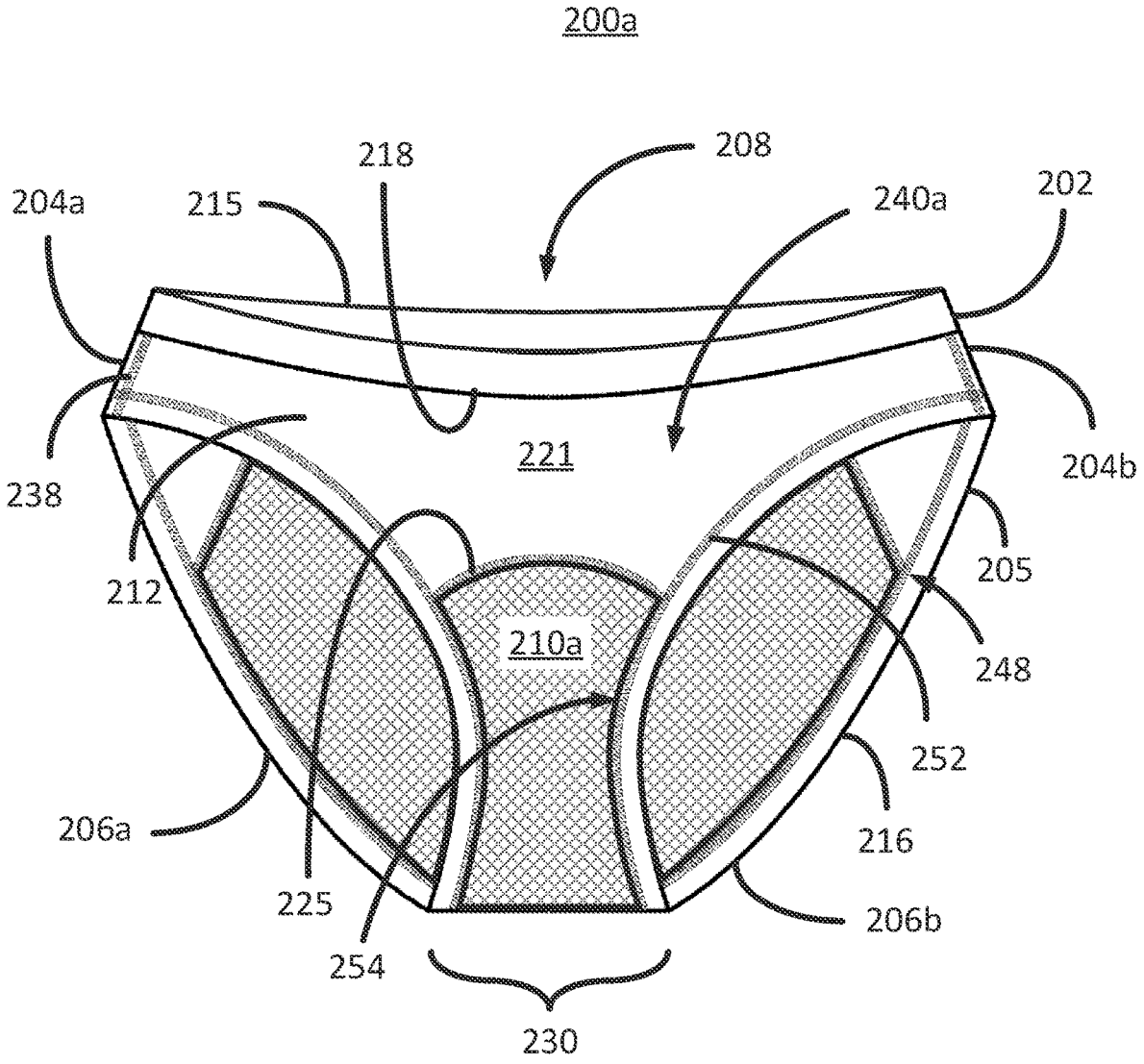
FIG. 2C is a line drawing of the front view of a bikini style underpants embodiment consistent with embodiments of the present invention.

FIG. 2C is a line drawing of the front view of a bikini style underpants embodiment consistent with embodiments of the present invention. The bikini style embodiment 200*a* is similar to the bikini style embodiment 200 of FIGS. 2A and 2B but with a different bikini front 240*a*. The bikini style embodiment 200*a* has the same bikini back 250 as the bikini style embodiment 200. This bikini front embodiment 200*a* differs from the bikini front embodiment 200 in that the center panel 210*a* at the bikini front 240*a* extends along towards the bikini sides 204 less than 50% of the leg cuffs 216 where they terminate between the bikini crotch region 230 and the waistband 202, but not at the waistband 202. In the present embodiment, the center panel 210*a* extends along and adjacent to the leg cuffs 216 at about 50%+/−10% of the leg openings 206 in the bikini front 240*a*. The center panel 210*a* extends from the leg cuff seam 252 at the center panel-to-cuff interface 254 towards the waistband 202, however the center panel 210*a* is sewn to a one-ply bamboo front panel 221 at front-to-center panel interface 225. There is no non-filter material (i.e., one-ply bamboo fabric) between the center panel 210 and the leg cuffs 216 at the center panel-to-cuff interface 254. The front panel 221 extends uninterruptedly from the left bikini side 204*a* to the right bikini side 204*b*. In the present embodiment, the center panel 210*a* is convex shaped at the front-to-center panel interface 225.

The embodiments presented in conjunction with FIG. 1C can equally be applied to the bikini underwear embodiments 200 and 200*a* of FIGS. 2A-2C, without departing from the scope and spirit of the present invention. Certain embodiments of the present invention distinguish themselves from embodiments of the prior art in that the activated carbon fiber filter material 302, the cotton fabric 304/306 the bamboo fabric 310/312 are non-polyamide fabrics, but rather all natural fabrics, which have superior breathability and filtering capability than polyamide fabrics. The underwear body 205 is permeable to air/gas and vapor, meaning that both gas and vapor exchange will occur through the center panel 110 and the side panels 120.

With the present description in mind, below are some examples of certain embodiments illustratively complementing some of the methods and apparatus embodiments to aid the reader. The elements called out below in view of the various figures are examples provided to assist in understanding the present invention and accordingly should not be considered limiting.

In that light, one embodiment of the present invention, described in view of figures, envisions an underpants embodiment 100 that generally comprises an underpants body 105 that extends between a waist aperture 108 and two leg apertures 106*a* and 106*b*. The underpants body 105 is geometrically defined by two underpants sides 104*a* and 104*b*, an underpants front 140 and an underpants back 150. Each of the leg apertures 106*a*/106*b* extend from one of the underpants sides 104*a*/104*b* to a crotch region 130 of the underpants body 105. An inseparable unitary elastic waistband 102 defining the waist aperture 108. The underpants body 105 comprises two side panels 120*a* and 120*b*, a center panel 110, as well as connective stitching 112 that holds the side panels 120 and the center panel 110 together. The connective stitching 112 also confines the center panel 110 and all of its laminated plies, irremovably to the underpants body 105. Each of the side panels 120*a*/120*b* extend from the waistband 102 to a corresponding one of the leg apertures 106*a*/106*b*. Each of the side panels 120*a*/120*b* completely encompass a corresponding one of the underpants sides 104*a*/104*b*. The center panel 110 extends from the waistband 102 at the underpants back 150 to the waistband 102 at the underpants front 140. The center panel 110 is interposed between the side panels 120*a*/120*b*. The center panel 110 passes through the crotch region 130 contiguously. The side panels 120*a*/120*b* consist of fabric that is a single layer of bamboo fabric. The center panel 110 consists of activated carbon fabric 302 bonded, via a bonding agent, to and sandwiched between a first layer of cotton fabric 304 and a second layer of cotton fabric 306, the cotton fabric 304/306 is irremovably sandwiched between a first outer layer of the bamboo fabric 310 and a second outer layer of the bamboo fabric 312. By irremovably sandwiched it is meant that the activated carbon fabric 302 and cotton fabric 304/306 (the laminate 308) cannot be removed from the underpants 100 without destroying the underpants 100 because the laminate 308 is sewn into, or otherwise irremovably attached to, the laminate 308.

Certain aspects of the underpants embodiment 100 are additionally envisioned to include a thickness of the center panel 110, which is greater than 1 mm. Certain embodiments contemplate the carbon fabric 302 being approximately 0.8 mm thick, the cotton fabric 304/306 being approximately 0.4 mm, the bamboo fabric 310/312 being approximately 0.25 mm thick, wherein the bonded three-ply cotton/carbon laminate 308 can have a thickness of approximately 1.5 mm with a total center panel 110 thickness being approximately 2 mm thick.

The underpants embodiment 100 is further envisioned having the activated carbon fabric 302, the first layer of cotton fabric 304 and the second layer of cotton fabric 306, and the bamboo fabric 310/312 are irremovably connected to the underpants.

The underpants embodiment 100 further contemplates the side panels 120*a*/120*b* and the center panel 110 are gas permeable and vapor permeable.

The underpants embodiment 100 further envisions the waist band 102 further comprising the activated carbon fabric 302.

The underpants embodiment 100 can further comprise at least one elastic member 160 attached at an interface between the center panel 110 and at least one of the side panels 120*a*/120*b*.

The underpants embodiment 100 further envisions the activated carbon fabric 302, the cotton fabric 304/306 and the bamboo fabric 310/312 are devoid of polyamides.

The underpants embodiment 100 can further include having the center panel 110 only extends over part of the wearer's buttocks when worn.

The underpants embodiment 100 can further be wherein the side panels 120*a* and 120*b* are not contiguous to one another.

The underpants embodiment 100 can further be wherein the center panel 110 widens from the crotch region 130 to the waistband 102 at the underpants back 150 and wherein an interface 113 between the center panel 110 and one of the side panels 120*a*/120*b* is configured to reside essentially over a buttocks apex 136 of a person when worn by the person.

The underpants embodiment 100 can further be wherein the center panel 110 widens from the crotch region 130 to the waistband 102 at the underpants back 150 and wherein an interface 113 between the center panel 110 in one of the side panels 120*a*/120*b* is configured to reside between a buttocks apex 136 of a person and a coronal plane (the side) of the person when worn by the person.

The underpants embodiment 100 can further be wherein the center panel 110 passes through the crotch region 130 and completely encompasses the crotch region 130.

The underpants embodiment 100 can further be wherein the two side panels 120*a* and 120*b* are a single ply of bamboo fabric.

The underpants embodiment 100 can further be wherein the two side panels 120*a* and 120*b* are a single ply of bamboo fabric except for a cuff 116 defined between a leg seam 114 and a corresponding one of the two leg apertures 106*a* and 106*b*.

The underpants embodiment 100 can further be wherein the underpants are devoid of any gusset in the crotch region 130.

The underpants embodiment 100 can further comprise a crotch dart 122 in the center panel 110 in the underpants front 140 extending from the crotch region 130 towards the waist band 102.

The underpants embodiment 100 can further be wherein the center panel 110 consists of a front panel 111*a* and a back panel 111*b* sewn together via a transfer seam 113 in the crotch region 130.

The underpants embodiment 100 can further comprise two leg cuffs 216 that encompassed each of the two leg apertures 206*a* and 206*b*, the center panel 210 extending along more than 50% of the leg cuffs 216 along and adjacent to a center panel-to-cuff interface 254 towards the two underpants sides 204*a* and 204*b*, the center panel-to-cuff interface 254 defines where the center panel 210 interfaces the two leg apertures 206*a* and 206*b*.

The underpants embodiment 100 can further be wherein the center panel 210 transitions from the leg cuff seam 252 towards the waistband 202 at essentially a sharp angle 246.

Yet another embodiment of the present invention further contemplates a filter undergarment 200 comprising an undergarment body 105 defined by two undergarment sides 204*a* and 204*b*, an undergarment front 240 and an undergarment back 250. The undergarment body 205 extends between an inseparable unitary elastic waistband 202 (waistband) and two leg apertures 206*a* and 206*b*. The filter undergarment further has a waist aperture 208 that is defined by a waistband edge 215 of the waistband 202. A center panel 210 extends from the waistband 202 at the under garment back 250, traversing between the two leg apertures 206*a* and 206*b* to the undergarment front 240. The center panel 210 is a five-ply filter fabric 300 that is essentially composed of an activated carbon fabric 302 that is bonded between two cotton fabric panels 304 and 306 that are sandwiched and attached between two bamboo fabric panels 310/312. By 'essentially composed' it is meant that there may be thread, glue or other minor elements that hold together the center panel 210 or provide attachment to the side panels 220 but the majority of the panels are the activated carbon fabric 302, cotton panels 304/306 and the bamboo panels 310/312. One-ply bamboo fabric encompasses the two undergarment sides 204*a* and 204*b*. There are two leg cuffs 216 each of which define one of the two leg apertures 106*a* and 106*b*, the leg cuffs 216 comprising a one-ply bamboo fabric folded over itself. A center panel-to-cuff interface 254 defines where the center panel 210 interfaces each of the leg cuffs 216. The center panel 210 extends between 35%-75% of the leg cuffs 216 along and adjacent to the center panel-to-cuff interface 254 and towards the two underpants sides 204*a* and 204*b* in the undergarment front 240 and the undergarment back 250.

The filter undergarment embodiment 100 further envisioning wherein the center panel 210 extends from the center panel-to-cuff interface 254 to a waistband interface 218 at the waistband 202. This can further be wherein the center panel 210 extends from the center panel-to-cuff interface 254 towards the waistband 202 at a sharp angle 246 where the center panel 210 transitions from the center panel-to-cuff interface 254.

The filter undergarment embodiment 100 further contemplating wherein the center panel 210 terminates from the center panel-to-cuff interface 254 into the one-ply bamboo fabric at a front-to-center panel interface 225, the front-to-center panel interface 225 extends from one of the leg cuffs 216 to the other of the leg cuffs 216.

Still another embodiment of the present invention contemplates a filter underwear 100 generally comprising an undergarment body 105 defined by two undergarment sides 104*a* and 104*b*, an undergarment front 140 and an undergarment back 150, wherein the undergarment body 105 extends between an inseparable unitary elastic waistband 102 (waistband) and two leg apertures 106*a* and 106*b*. A waist aperture 108 is defined by a waistband edge 115 of the waistband 102. The filter underwear 100 further includes a center panel 110 attached to and extending from the waistband 102 at the under garment back 150 and traversing between the two leg apertures 106*a* and 106*b* to the waistband 102 at the undergarment front 140. The center panel 110 is configured to only extend over part of a wearer's buttocks when worn by a wearer. The center panel 110 is a filter fabric 300 comprising five plies, wherein each ply is from a set consisting of an activated carbon fabric 302, a cotton fabric 304/306, and bamboo fabric 310/312. The activated carbon fabric 302 is bonded between two sheets of cotton fabric 304 and 306 that are sandwiched between and irremovably attached to bamboo fabric 310 and 312. The center panel 110 is greater than 1 mm thick. The filter underwear 100 has one-ply bamboo fabric side panels 120*a* and 120*b* that each comprise one of the undergarment sides 104*a* and 104*b*. The undergarment is permeable to gas and vapor. The waist band 102 can further comprise the activated carbon fabric 302 in yet another embodiment.

It is to be understood that even though numerous characteristics and advantages of various embodiments of the present invention have been set forth in the foregoing description, together with the details of the structure and function of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. For example, the term 'attached' can mean to be sewn, glued, stapled or some other affixing means known to those skilled in the art without departing from the scope and spirit of the present invention. Furthermore, it should be appreciated that certain geometrical elements and description of similar elements in FIGS. 1A-1C are able to be exchanged with those described in conjunction with FIGS. 2A-2C and vice versa without departing from the scope and spirit of the present invention. Also, though different undergarment embodiments can be inventive as a whole, individual undergarment components or elements can be equally inventive and stand alone. Further, the terms "one" is synonymous with "a", which may be a first of a plurality.

It will be clear that the present invention is well adapted to attain the ends and advantages mentioned as well as those inherent therein. While presently preferred embodiments have been described for purposes of this disclosure, numerous changes may be made which readily suggest themselves to those skilled in the art and which are encompassed in the spirit of the invention disclosed.

What is claimed is:

1. Underpants comprising:

an underpants body that extends between a waist aperture and two leg apertures, the underpants body is geometrically defined by two underpants sides, an underpants front and an underpants back;

each of the leg apertures extending from one of the underpants sides to a crotch region of the underpants body;

an inseparable unitary elastic waistband defining the waist aperture;

the underpants body comprising two side panels, a center panel, and connective stitching, each of the side panels extending from the waistband to a corresponding one of the leg apertures, each of the side panels completely encompassing a corresponding one of the underpants sides, the center panel extending from the waistband at the underpants back to the waistband at the underpants front, the center panel interposed between but separating the side panels, the center panel passing though the crotch region contiguously, the center panel configured to only extend over part of a wearer's buttocks when worn by a wearer;

the side panels comprising a fabric that consists of a single layer of bamboo fabric, the center panel consisting of activated carbon fabric bonded, via a bonding agent, to and sandwiched between a first layer of cotton fabric and a second layer of cotton fabric, the first layer of cotton fabric and the second layer of cotton fabric irremovably sandwiched between a first outer layer of the bamboo fabric and a second outer layer of the bamboo fabric.

2. The underpants of claim 1 wherein a thickness of the center panel is greater than 1 mm.

3. The underpants of claim 1 wherein the activated carbon fabric, the first layer of cotton fabric and the second layer of cotton fabric are irremovably connected to the underpants.

4. The underpants of claim 1 wherein the side panels and the center panel are gas permeable and vapor permeable.

5. The underpants of claim 1 wherein the waistband further comprises the activated carbon fabric.

6. The underpants of claim 1 further comprising at least one elastic member attached at an interface between the center panel and at least one of the side panels.

7. The underpants of claim 1 wherein the activated carbon fabric, the cotton fabric and the bamboo fabric are devoid of polyamides.

8. The underpants of claim 1 wherein the center panel widens from the crotch region to the waistband at the underpants back and wherein an interface between the center panel and one of the side panels is configured to reside essentially over a buttocks apex of a person when worn by the person.

9. The underpants of claim 1 wherein the center panel widens from the crotch region to the waistband at the underpants back and wherein an interface between the center panel in one of the side panels is configured to reside between a buttocks apex of a person and a coronal plane of the person when worn by the person.

10. The underpants of claim 1 wherein the center panel passes through the crotch region and completely encompasses the crotch region.

11. The underpants of claim 1 further comprising a crotch dart in the center panel in the underpants front extending from the crotch region towards the waistband.

12. The underpants of claim 1 wherein the center panel consists of a front panel and a back panel sewn together via a transfer seam in the crotch region.

13. The underpants of claim 1 further comprising two leg cuffs that encompass each of the two leg apertures, the center panel extending along more than 50% of the leg cuffs along and adjacent to a center panel-to-cuff interface towards the two underpants sides, the center panel-to-cuff interface defines where the center panel interfaces the two leg apertures.

14. The underpants of claim 1 wherein the center panel transitions from a leg cuff seam towards the waistband at essentially a sharp angle.

15. A filter undergarment comprising:

an undergarment body defined by two undergarment sides, an undergarment front and an undergarment back, the undergarment body extending between a waistband and two leg apertures, a waist aperture defined by a waistband edge of the waistband;

a center panel extending from the waistband at the under garment back and traversing between the two leg apertures to the undergarment front, the center panel is a five-ply filter fabric that is essentially composed of an activated carbon fabric that is bonded between two cotton fabric panels that are sandwiched and attached between two bamboo fabric panels;

a one-ply bamboo fabric encompassing the two undergarment sides;

two leg cuffs each of which defining one of the two leg apertures, the leg cuffs comprising a one-ply bamboo fabric folded over itself;

a center panel-to-cuff interface defining where the center panel interfaces each of the leg cuffs, the center panel extends between 35%-75% of the leg cuffs along and adjacent to the center panel-to-cuff interface and towards the two underpants sides in the undergarment front and the undergarment back.

16. The filter undergarment of claim 15 wherein the center panel extends from the center panel-to-cuff interface to a waistband interface at the waistband.

17. The filter undergarment of claim 16 wherein the center panel extends from the center panel-to-cuff interface towards the waistband at a sharp angle where the center panel transitions from the center panel-to-cuff interface.

18. The filter undergarment of claim 15 wherein the center panel terminates from the center panel-to-cuff interface into the one-ply bamboo fabric at a front-to-center panel interface, the front-to-center panel interface extends from one of the leg cuffs to the other of the leg cuffs.

19. A filter underwear comprising:

an undergarment body defined by two undergarment sides, an undergarment front and an undergarment back, the undergarment body extending between an inseparable unitary elastic waistband (waistband) and two leg apertures, a waist aperture defined by a waistband edge of the waistband;

a center panel attached to and extending from the waistband at the under garment back and traversing between the two leg apertures to the waistband at the undergarment front, the center panel configured to only extend over part of a wearer's buttocks when worn by a wearer;

the center panel is a filter fabric comprising five plies, wherein each ply is from a set consisting of an activated carbon fabric, a cotton fabric, a bamboo fabric, the center panel is arranged with the activated carbon fabric bonded between two sheets of cotton fabric that are sandwiched between and irremovably attached to bamboo fabric, the center panel is greater than 1 mm thick;

two one-ply bamboo fabric side panels that each comprise one of the undergarment sides, the undergarment body permeable to gas and vapor.

20. The filter underwear of claim 19 wherein the waistband further comprises the activated carbon fabric.

* * * * *